United States Patent [19]

Bobb

[11] 4,283,030

[45] Aug. 11, 1981

[54] RAILWAY SWITCH HEEL BLOCK

[75] Inventor: Frank P. Bobb, Camp Hill, Pa.

[73] Assignee: Bethlehem Steel Corporation, Bethlehem, Pa.

[21] Appl. No.: 122,928

[22] Filed: Feb. 20, 1980

[51] Int. Cl.[3] ..... E01B 7/10

[52] U.S. Cl. ..... 246/468; 246/435 R

[58] Field of Search ..... 246/435 R, 435 A, 441, 246/452, 468–472

[56] References Cited

U.S. PATENT DOCUMENTS

| | | | |
|---|---|---|---|
| 765,526 | 7/1904 | Vaughan | 246/468 |
| 1,370,792 | 3/1921 | Dorsey | 246/435 R |
| 1,589,954 | 6/1926 | Gerhard | 246/435 R |
| 2,174,367 | 9/1939 | Hoffman | 246/468 |
| 3,521,053 | 7/1970 | Hayn et al. | 246/468 |

FOREIGN PATENT DOCUMENTS

| | | | |
|---|---|---|---|
| 1350712 | 11/1962 | France | 246/468 |

*Primary Examiner*—Richard A. Bertsch

*Attorney, Agent, or Firm*—Joseph J. O'Keefe; Michael J. Delaney; Anson W. Biggs

[57] ABSTRACT

Apparatus for providing the proper spread between the switch rail and stock rail in a railway switch which includes a heel block of unique design which assures accurate alignment of the parts of the switch heel block.

5 Claims, 3 Drawing Figures

RAILWAY SWITCH HEEL BLOCK

BACKGROUND OF THE INVENTION

This invention relates to railway trackwork and more particularly to an improved switch heel block.

A typical railway turnout includes a switch stand, stock rails, movable switch point rails, frog and closure rails. A switch heel block, which may be a casting or a fabricated structure made by welding tough rolled steel components together, or bolting rolled bars together is a rigid structure for maintaining the gage at the heel end of a switch and is designed to keep the closure rail and switch point in correct alignment both vertically and horizontally. A switch heel block comprises a plurality of parts, i.e. joint bars or plates, bolts and struts and/or thimbles welded between the bars. Since these parts are manufactured in the shop and sent to the field for assembly it is essential that bolt holes be accurately located for proper alignment. On occasion the holes are out of location and/or contain burrs from the drilling operation. The field assembly of the heel block parts is difficult when the holes in the bars and rail webs do not line up accurately requiring additional field work, i.e. reaming the holes and welding struts to insure perfect alignment of the bolts through the bars and rail webs.

SUMMARY OF THE INVENTION

It is therefore an object of the instant invention to provide an improved apparatus which will insure perfect alignment of the parts in a switch heel block.

It is a further object of the instant invention to provide a heel block having fewer parts.

It is still another object of the invention to provide a preassembled heel block structure for easy and rapid installation in the field.

The present invention accomplishes these objects by providing a heel block structure wherein the stock rail, fixed closure rail and movable switch point are all rigidly clamped together. The heel block comprises a first pair of flat joint bars adjacent and substantially parallel to the outside of the webs of the rails and a second pair of flat joint bars adjacent and substantially parallel to the inside of the webs of the rails. The upper surface of the joint bars bears against the underside of the head of the rails and the lower surface of the joint bars bears against the base flange of the rails. The webs of the rails are formed with bolt holes and the joint bars are formed with transversely aligned bolt holes to register with the bolt holes in the webs of the rails. The bolt hole in the second pair of flat joint bars are of a diameter sufficient to permit passage of pipe separator thimbles therethrough. The pipe separator thimbles are fixed, e.g. by welding to the second pair of flat joint bars and extend completely therethrough thus forming a guide sleeve for clamping bolts to facilitate assembly and assure perfect alignment.

DESCRIPTION OF THE PREFERRED EMBODIMENT

Figure 1:
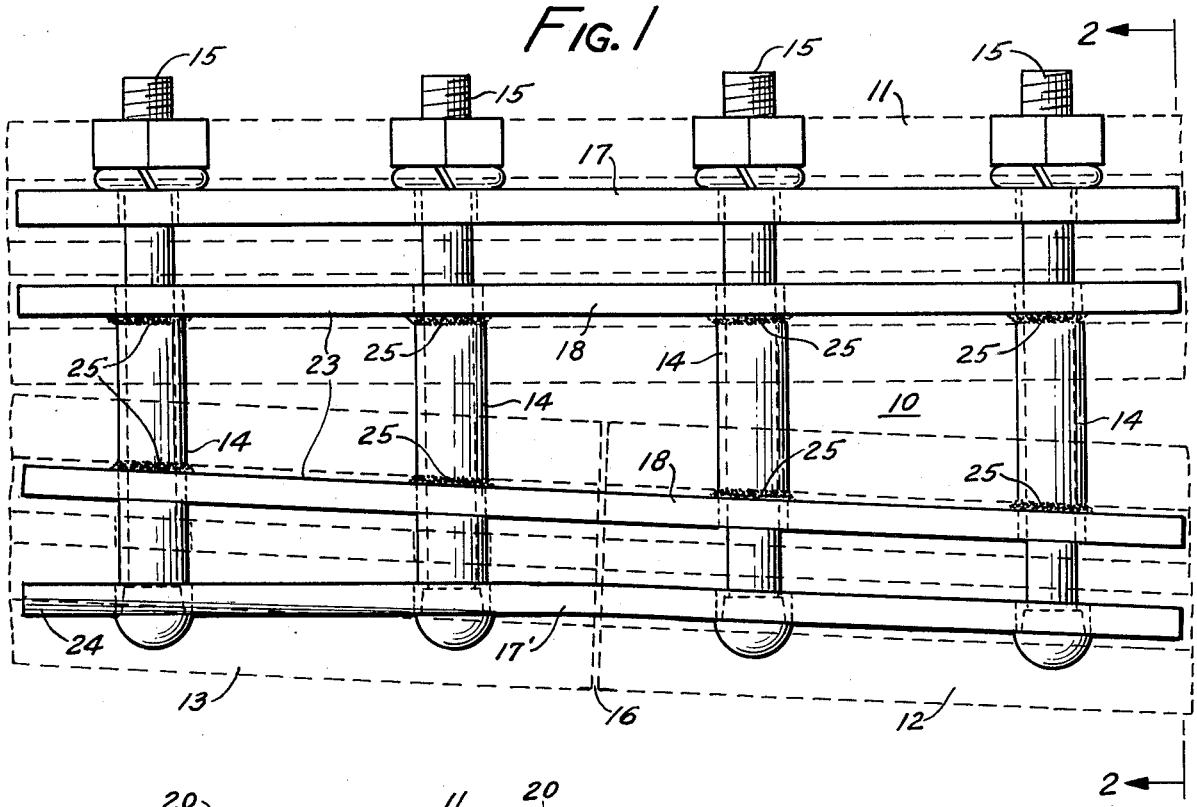
FIG. 1 is a plan view of a railway switch and heel block structure embodying the invention.

Referring now to the drawings for a detailed description of the invention and more particularly to FIG. 1, the heel block 10 of the instant invention generally comprises stock rail 11, fixed closure rail 12, movable switch rail 13, pipe thimble separators 14, joint bars 17, 17', and 18 and clamping bolts 15.

Figure 2:
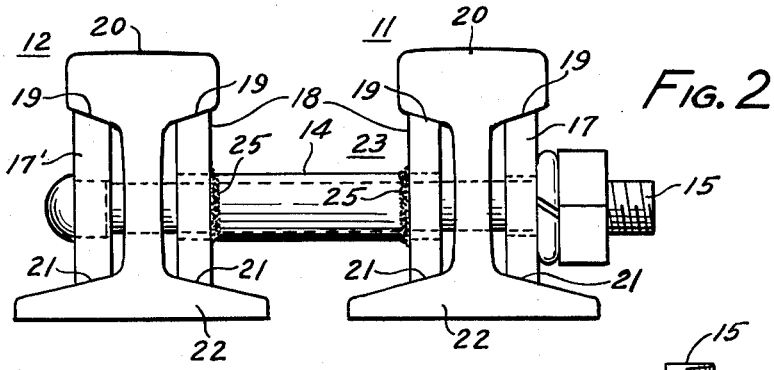
FIG. 2 is a view taken on line 2—2 of FIG. 1.
Figure 3:
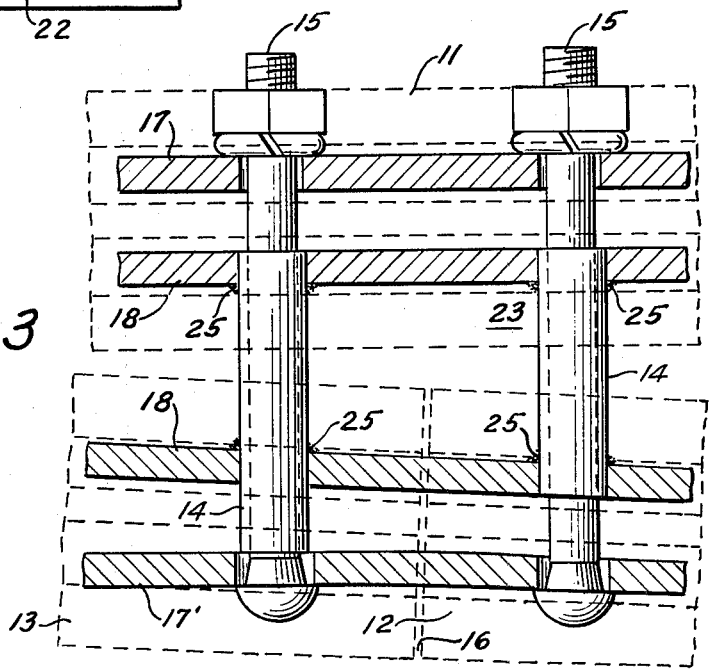
FIG. 3 is a fragmentary view of a portion of the heel block of FIG. 1 with parts removed for clarity.

The switch joint 16 occurs at the jointure of the movable switch rail 13 and the fixed closure rail 12. The heel block structure comprises a first pair of flat joint bars 17, 17' adjacent to and substantially parallel to the outside of the webs of the rails 11, 12 and 13; a second pair of flat joint bars 18 adjacent to and substantially parallel to the inside of the webs of rails 11, 12 and 13; pipe separators 14 and clamping bolts 15. As best seen in FIG. 2 the upper surface 19 of the flat joint bars is milled to fit against the underside of the rail head 20. Similarly the bottom surface 21 of the joint bars is milled to fit firmly against the base flange 22 of the rails.

The second pair of flat joint bars 18 are provided with holes transversely aligned to register with holes in the rail webs and the holes in bars 18 are of a diameter sufficient to permit the passage of separator pipe thimbles 14 therethrough. It is clear that the pipe thimble 14 size is chosen to allow the passage of the desired size clamping bolt 15 therethrough. The pipe thimbles 14 are fixed as by welding at 25 to the second pair of flat joint bars 18 forming an integral unit 23 therewith.

The flat joint bar 17' on the outside of the movable switch rail 13 and the fixed closure rail 12 is bent slightly, as will be understood by those skilled in the art, to permit slight movement at the heel block end of the movable switch rail 13 as the switch is opened and closed. The top surface 19 of the flat joint bar 17' is machined to form a taper portion 24 starting from the joint end 16 of the joint bar 17' toward the switch point. This taper allows free travel of wheels traveling through the heel block without interfering with the joint bar 17'.

The pipe thimble separators 14 extend completely through flat joint bars 18 forming a guide for free passage of the clamping bolts 15 during assembly and strengthening the integral heel block unit 23. The separators 14 registered with the holes in movable switch rail 13 extend through the joint bar 18 to the joint bar 17'. The holes in the web of switch rail 13 are drilled to permit passage of the pipe thimble separators 14 and allow slight movement of the web thereon as the switch is operated. The flat joint bar 17' is bent slightly at the joint 16 to permit clearance for movement of the switch rail 13.

The bolt holes in flat joint bar 17' are elongated, e.g., oval shaped to accommodate the buttonhead oval neck bolts 15 which clamp the joint bars 17, integral heel block unit 23 and rails 11 and 12 into a rigid switch heel block structure.

The invention thus described provides the railway industry with a switch heel block which insures the proper spread between the switch and stock rail. The primary advantage of the invention is the ease of the manufacturing process because of the perfect alignment provided by the long through-the-bar design pipe thimble separators. Burrs and holes out of location are prevented resulting in easy manufacture of the heel block. The alignment of the thimbles eliminates binding of bolts and replaces the need for struts to strengthen the structure.

I claim:

1. In a railway switch heel block structure including a stock rail, a fixed closure rail, a movable switch point rail and a heel block; the heel block having a first pair of flat joint bars adjacent and substantially parallel to the outside of the webs of said rails and a second pair of flat joint bars adjacent and substantially parallel to the inside of the webs of said rails , with an upper surface of said joint bars bearing against the underside of the head of said rails and a lower surface of said joint bars bearing against the base flange of said rails, the webs of said rails being formed with bolt holes and said joint bars being formed with transversely aligned bolt holes to register with the bolt holes through said webs; the improvement comprising:

a preassembled integral heel block unit having pipe separator thimbles fixed to said second pair of flat joint bars and extending completely therethrough, and clamp bolts extending through said separator thimbles and said first and second pairs of flat joint bars and said rail webs for clamping said flat joint bars and said rails in a rigid structure.

2. In a railway switch heel block structure as described in claim 1 wherein said bolt holes in one of said first pair of flat joint bars are elongated.

3. In a railway switch heel block structure as described in claim 2 wherein said clamp bolts are button head oval neck bolts.

4. In a railway switch heel block structure as described in claims 1, 2 or 3 wherein at least some of said pipe separator thimbles extend through the switch point rail web.

5. In a railway switch heel block structure as described in claim 4 wherein the flat joint bar of said first pair of flat joint bars adjacent the outside of said switch rail has the top surface thereof tapered from the rail joint toward the switch point.

* * * * *